US005302214A

United States Patent [19]

Uematsu et al.

[11] Patent Number: 5,302,214

[45] Date of Patent: Apr. 12, 1994

[54] HEAT RESISTING FERRITIC STAINLESS STEEL EXCELLENT IN LOW TEMPERATURE TOUGHNESS, WELDABILITY AND HEAT RESISTANCE

[75] Inventors: Yoshihiro Uematsu; Naoto Hiramatsu; Sadayuki Nakamura, all of Yamaguchi, Japan

[73] Assignee: Nisshin Steel Co., Ltd., Tokyo, Japan

[21] Appl. No.: 976,840

[22] Filed: Nov. 16, 1992

Related U.S. Application Data

[63] Continuation-in-part of Ser. No. 775,990, Nov. 20, 1991, abandoned.

[30] Foreign Application Priority Data

Mar. 24, 1990 [JP] Japan ..... 2-74785

[51] Int. Cl.[5] ..... C22C 38/22; C22C 38/20

[52] U.S. Cl. ..... 148/325; 420/69

[58] Field of Search ..... 148/325; 420/69

[56] References Cited

U.S. PATENT DOCUMENTS 5,110,544 5/1992 Sato et al. ..... 420/40

FOREIGN PATENT DOCUMENTS 57-85960 5/1982 Japan .
59-52226 12/1984 Japan .
61-44121 10/1986 Japan .
62-112757 5/1987 Japan .
64-8254 1/1989 Japan .
2-145752 6/1990 Japan .

*Primary Examiner*—Deborah Yee
*Attorney, Agent, or Firm*—Lowe, Price, LeBlanc & Becker

[57] ABSTRACT

A heat resisting ferritic stainless steel which comprises, by weight, up to 0.03% of C, from 0.1 to 0.8% of Si, from 0.6 to 2.0% of Mn, up to 0.006% of S, up to 4% of Ni, from 17.0 to 25.0% of Cr, from 0.2 to 0.8% of Nb, from 1.0 to 4.5% of Mo, from 0.1 to 2.5% of Cu, and up to 0.03% of N, and optionally one or more of appropriate amounts of Al, Ti, V, Zr, W, B and REM, the balance being Fe and unavoidable impurities, wherein the alloying elements are further adjusted so that the ratio of Mn%/S% is not less than 200, [Nb] defined by the equation: [Nb]=Nb%−8 (C%+N%) is not less than 0.2, and (Ni%+Cu%) is not more than 4. The stainless steel according to the invention is suitable for use in constructing an exhaust gas path-way of an automobile, particularly, a path-way from an engine to a converter, which is exposed to high temperatures, and which requires an improved low temperature toughness and a high resistance to weld cracking due to high temperatures.

10 Claims, 5 Drawing Sheets

HEAT RESISTING FERRITIC STAINLESS STEEL EXCELLENT IN LOW TEMPERATURE TOUGHNESS, WELDABILITY AND HEAT RESISTANCE

RELATED APPLICATION

This application is a continuation-in-part application to our application Ser. No. 07/775,990, filed Nov. 20, 1991, now abandoned.

FIELD OF THE INVENTION

The present invention relates to a heat resisting ferritic stainless steel excellent in low temperature toughness, weldability and heat resistance. The stainless steel according to the invention is suitable for use in composing a part of an exhaust gas path-way of an automobile, especially, a path-way from an engine to a converter, which is exposed to high temperatures.

BACKGROUND OF THE INVENTION AND PRIOR ART

In recent years, air pollution caused by an automobile exhaust gas has become a serious problem and NOx, HC, CO, etc. of the exhaust gas have been restricted in quantities from a view point of preventing environmental pollution. The restriction is now getting more and more severe in consideration of acidic rain and others. Therefore, it is necessary to further improve an efficiency of the exhaust gas purification.

On the other hand, a recent increasing demand for a more powerful and capable engine tends to rise up the exhaust gas temperature. Under the circumstances, parts of an exhaust gas system are exposed to higher temperatures while driving the engine. Particularly, parts between the engine and a converter of exhaust gas purifying instruments, for example, an exhaust manifold, dual tube and the like, cannot help being exposed to still higher temperatures. In addition, these parts undergo not only changes in mechanical stress due to oscillation caused by driving the engine and running of the automobile, but also changes in temperature due to heating and cooling cycles depending upon patterns of driving and, in some cases, to freezing in cold areas. Thus, the parts are exposed to mechanically and thermally severe conditions.

As long as a heat resisting steel, for example, a stainless steel is applied as a material for the production of these parts, heat resistivity, of course, is excellent. However, because of weld-joints (the pipe used for these parts is usually made by weld and is often jointed to other parts by weld), the material must be excellent in weldability and in mechanical workability. Therefore, it is important that the material used for this purpose must be not only corrosion resistant which is the fundamental property of a stainless steel but also heat resistant, tough at low temperature, weldable and workable.

SUS304, a typical austinitic stainless steel, has been considered as a favorable material for use for the above-mentioned purpose because of its excellent workability and favorable weldability. However, since an austinitic stainless steel has a large thermal expansion coefficient, fears are entertained for a thermal fatigue cracking caused by a thermal stress which comes about in the repeated heating and cooling. In addition, because of a large difference in thermal expansion between an austinitic stainless steel and its surface oxide, the oxide layer tends to splinter off from the surface of the steel. For these reasons, a nickel base alloy represented by Inconel 600 is used in some parts as the pathway material for an exhaust gas of an automobile. This alloy is promising for the reasons that its thermal expansion coefficient is small whereby the oxide layer is tight adhesive to the surface and, in consequence, it is excellent in high temperature oxidation resistance as well as high temperature strength. However, this alloy is very expensive so that it is not extensively used.

On the other hand, when compared with the austinitic stainless steel, a ferritic stainless steel is cheap and, in addition, excellent in thermal fatigue properties because of its small thermal expansion coefficient, so that it is considered suitable for use in parts which are subjected to cyclic variation of temperature such as heating and cooling. Type 409 or SUS430, a representative of the ferritic stainless steel, is going on to use in part of an automobile exhaust gas path-way . However, these materials have a property that the strength goes sharply down as the temperature 900° C. and higher, and in consequence, give rise to problems of which one is fatigue cracking due to insufficient strength and the other is abnormal oxidation when conditions go beyond the limit of oxidation resistivity. A counter action to these problems may be possible by means of addition of various alloying elements, which improve high temperature strength, or by means of increasing a chromium content to improve oxidation resistance. However, such means of addition of alloying elements or increase of chromium content make, in general, not only impact toughness of the steel weaken steeply but also weldability and workability get worse remarkably.

Any stainless steel that is in conformity with the above-mentioned conditions becoming more and more severe according to the demands for a more powerful and capable engine and for the progress of a purification efficiency of an exhaust gas is not come out yet. In other words, a material which is economical and satisfies simultaneously various demands for properties such as high temperature strength, oxidation resistance, heat resistance, toughness, weldability and workability is not yet obtainable from austinitic or the ferritic stainless steels nowadays. If a ferritic stainless steel retaining the previously stated desirable properties inherent to the ferritic stainless steel, and having improved heat resistivity and high temperature strength and, in addition, being excellent in productivity, workability, weldability and low temperature toughness comes to be obtainable, it may be said that such a material is very promising for the particular use mentioned above.

JP A 64-8254 discloses a ferritic stainless steel for the like use, but is completely silent with respect to low temperature toughness. JP B 59-52226 and 61-44121 disclose to improve a ferritic stainless steel in its rust development due to chlorine ion and its acid resistivity by adding copper and nickel while extremely lowering S, but teach nothing about high temperature strength, heat resistance, weldability and low temperature toughness.

OBJECTS OF THE INVENTION

Accordingly, an object of the invention is to provide a ferritic stainless steel having properties which simultaneously meet the above-mentioned many severe conditions required for a material of an automobile exhaust gas path-way, particularly, of a part between an engine and a converter where the material is exposed to high temperatures. Another object of the invention is to improve low temperature toughness, which is an inherent defect of ferritic stainless steels. A further object of the invention is the provision of a heat resistive ferritic stainless steel which does not suffer from a problem of high temperature cracking of weld heat-affected zone.

SUMMARY OF THE INVENTION

The invention provides a heat resisting ferritic stainless steel excellent in low temperature toughness, weldability, and heat resistance which comprises, by weight, up to 0.03% of C,
from 0.1 to 0.8% of Si,
from 0.6 to 2.0% of Mn,
up to 0.006% of S,
up to 4% of Ni,
from 17.0 to 25.0% of Cr,
from 0.2 to 0.8% of Nb,
from 1.0 to 4.5% of Mo,
from 0.1 to 2.5% of Cu, and
up to 0.03% of N, the balance being Fe and unavoidable impurities, wherein the alloying elements are further adjusted so that the ratio of Mn%/S% is not less than 200, [Nb] defined by the equation:

$$[Nb] = Nb\% - 8\,(C\% + N\%)$$

is not less than 0.2, and (Ni%+Cu%) is not more than 4.

The invention further provides a heat resisting ferritic stainless steel excellent in low temperature toughness, weldability and heat resistance which comprises, in addition to the elements of the above-mentioned steel, one or more of:

up to 0.5% of Al,
up to 0.6% of Ti,
up to 0.5% of V,
up to 1.0% of Zr,
up to 1.5% of W,
up to 0.01% of B, and
up to 0.1% of REM.

DETAILED DESCRIPTION OF THE INVENTION

After many experimental researches to achieve the object mentioned before, the inventors have been able to obtain the following information.

Figure 1:
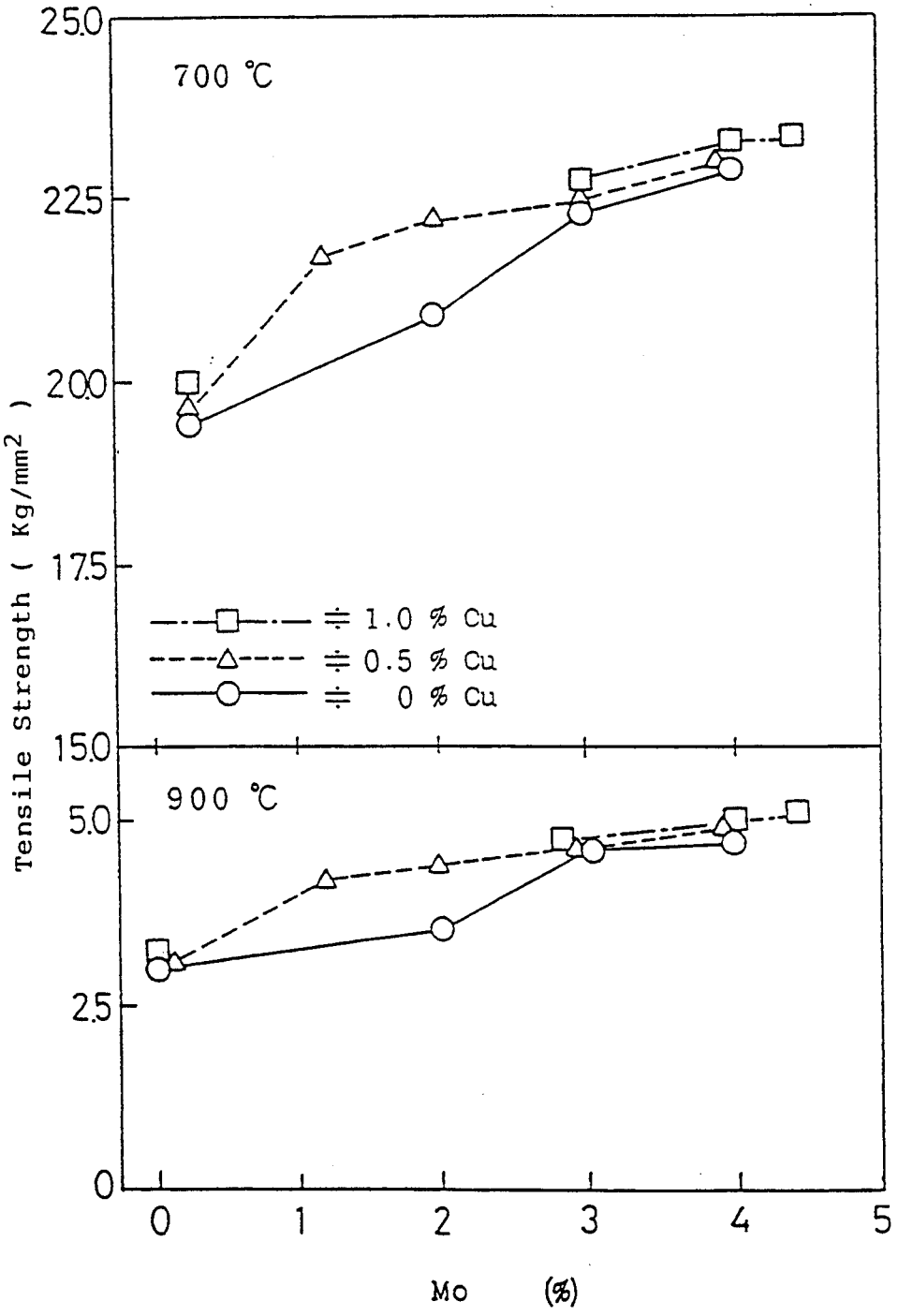
FIG. 1 shows a relationship between molybdenum content and tensile strength at the indicated elevated temperatures obtained by the elevated temperature tensile test noted below.

FIG. 1 shows results of the tensile tests at the indicated elevated temperatures carried out on materials having a basic composition of Fe-18% Cr-0.45%-Nb with various Mo and Cu contents to examine effects of Mo and Cu on high temperature tensile strength. As seen from the figure, high temperature strength is improved by the addition of molybdenum in an amount of 1% or more. Furthermore, the conjoint addition of molybdenum and copper is more effective than the addition of molybdenum alone to improve high temperature strength.

Figure 2:
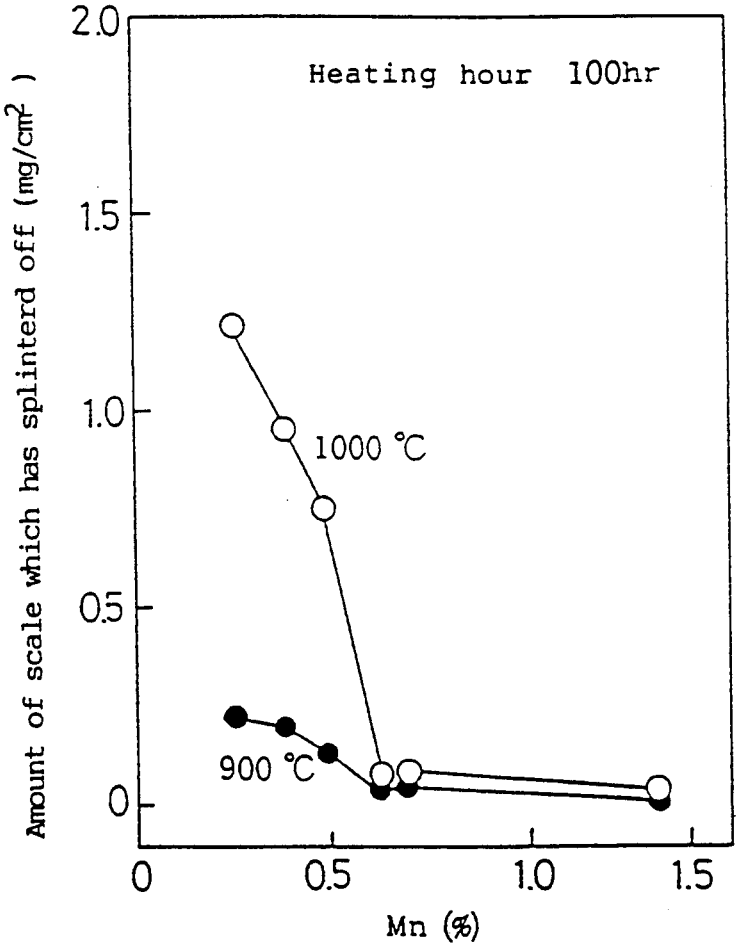
FIG. 2 shows a relationship between manganese content and amount of scale which has splintered off after the elevated temperature oxidation test noted below.

FIG. 2 shows results of the oxidation tests at the indicated elevated temperatures carried out on materials having a basic composition of Fe-18% Cr-0.45%-Nb with various Mn contents. The oxidation was continued in air for 100 hrs at 900° C. or 1000° C., and at the end of the period an amount of scale which had splintered off was measured. As seen from the figure, the scale splintering was suppressed, irrespective of the oxidation temperature tested, by the addition of at least about 0.6% of manganese. Thus, it can be understood that, as for the ferritic stainless steel, manganese makes the limit of oxidation resistivity to rise up.

Figure 3:
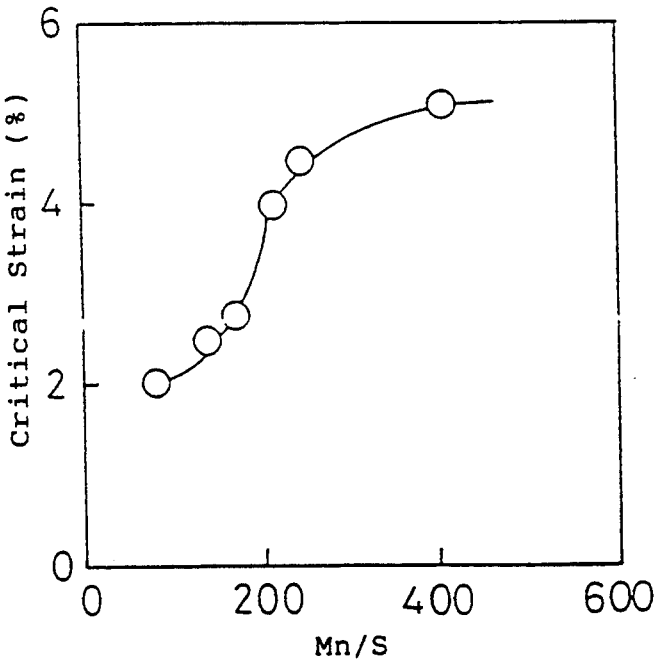
FIG. 3 shows a relationship between Mn/S and critical strain obtained by the weld high temperature cracking test noted below.

FIG. 3 shows results of the weld high temperature affected cracking test on materials having a basic composition of Fe-18% Cr-0.45%-Nb with appropriate Mo and Cu contents whose effects are recognized as shown in FIG. 1 (3% Mo and 0.5% Cu) and with varied Mn and S contents to examine effects of the ratio, Mn/S, on weld high temperature affected cracking. The test was carried out as follows. The cold rolled and annealed plate of 1.2 mm in thickness was cut into test pieces of 40 mm×200 m. The test pieces were TIG welded under various tensile stresses imposed longitudinally. The minimum strain at which cracking began to occur was determined, which is referred to herein as the critical strain and is a measure of the susceptibility to the weld high temperature affected cracking. It is revealed from FIG. 3 that if the ratio, Mn/S, is 200 or higher, ferritic stainless steels having conjointly incorporated with Mo and Cu have an increased critical strain, and, in consequence, an improved weldability. Thus, in order to overcome the weld high temperature affected cracking it is effective to add a proper amount of Mn rendering the ratio, Mn/S, not less than 200.

Figure 4:
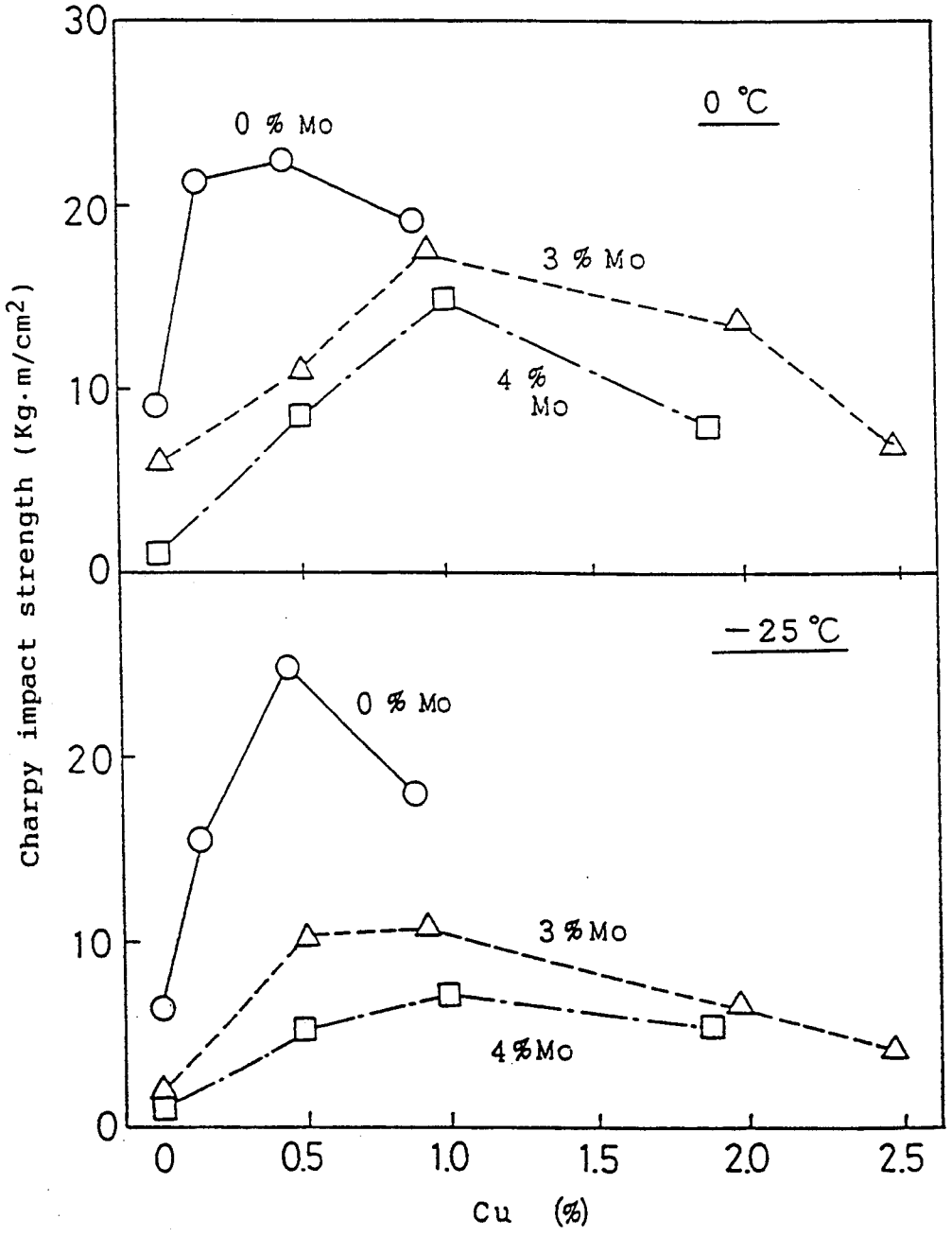
FIG. 4 shows a relationship between copper content and Charpy impact strength obtained by the Charpy impact test at the indicated temperatures. The invention is based on the results shown in these figures.

FIG. 4 shows results of the Charpy impact test carried out on materials having a basic composition of Fe-18 Cr-0.45%-Nb with varied Mo and Cu contents for examining effects of molybdenum and copper on toughness. The impact value is lowered by the addition of molybdenum, as is known in the art. However, FIG. 4 provides new information that the reduction in the impact value due to Mo may be compensated to some extent by conjoint addition of Cu. Particularly, even with such a material as a steel containing 4% of molybdenum whose impact toughness is remarkably low, the conjoint addition of copper improves the impact value well enough. Furthermore, the conjoint addition of nickel and molybdenum can also improve low temperature impact toughness, as will be manifested in Examples described later. The information of these facts is of great importance, particularly for a material which constitutes parts exposed to low temperature circumstance in winter, for example, a manifold or dual tube which suffer from mechanical vibration in addition to low temperature when the engine starts, whereupon the material will become usable even under further more severe conditions expected in the future.

Figure 5:
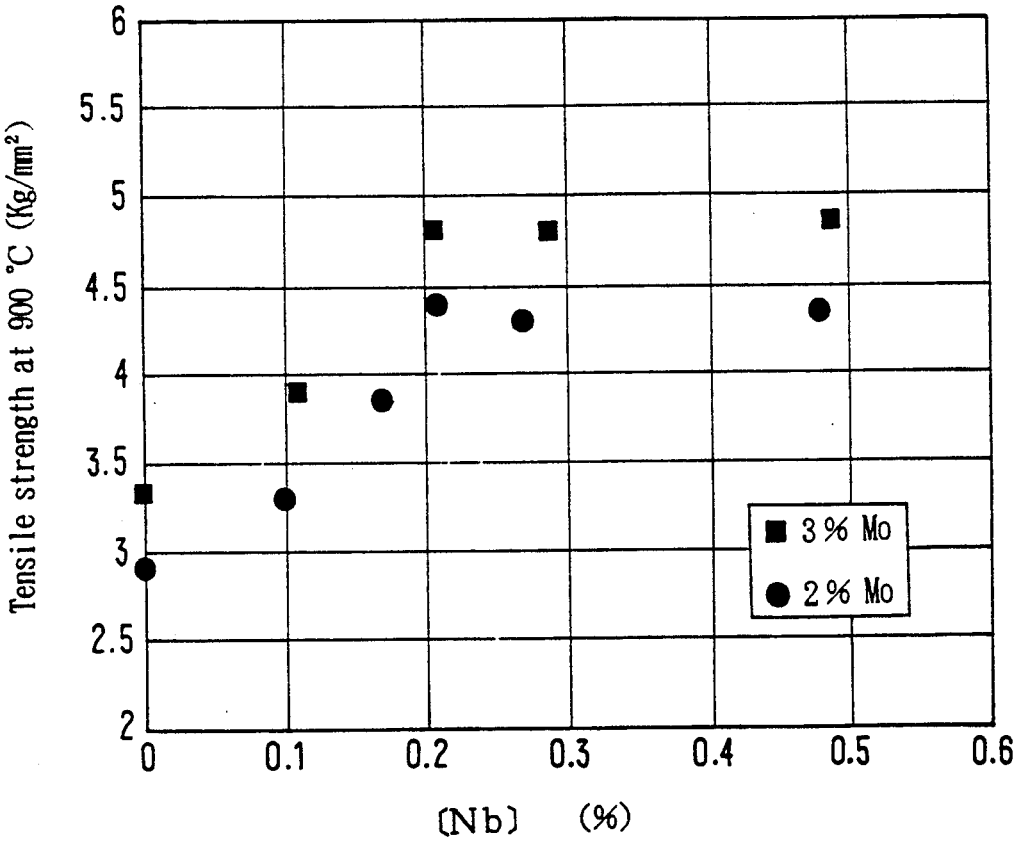
FIG. 5 shows a relationship between [Nb], which is Nb%−8 (C%+N%), and tensile strength at 900° C. obtained by the elevated temperature tensile test noted below.

FIG. 5 shows results of the tensile strength test carried out at a temperature of 900° C. on materials having basic compositions of Fe-18% Cr-3% Mo and Fe-18% Cr-2% Mo with varied [Nb] contents for examining effects of [Nb] on tensile strength at an elevated temperature. FIG. 5 reveals that at least 0.2% of [Nb] will be required to improve high temperature strength.

Based on the information noted above, the invention provides a ferritic stainless steel having well-balanced excellent properties as a whole, including high temperature strength, thermal fatigue resistance, oxidation resistance and low temperature toughness.

The reasons for the restriction of each chemical component in the steel according to the invention will now be outlined.

C and N:C and N are, in general, important elements because of promoting high temperature strength, but excessive amounts of them demote oxidation resistance, workability and toughness. Besides above, C and N react and form compounds with Nb, thereby lowering the effective Nb in the ferritic phase. Accordingly, it is favorable that C and N are small in quantities, so that they should be controlled not more than 0.03%, respectively.

Si: Si is an effective element to improve oxidation resistance, but an excessive amount of Si renders the steel hard, and, in consequence, adversely affects workability and toughness. Therefore, Si is controlled within the range from 0.1% to 0.8%.

Mn:Mn reacts with S, which is harmful for weld high temperature affected cracking, and fixes S in the form of MnS, whereby S is removed or reduced in welded metal . It has been found that if the relation, $Mn/S \geqq 200$, is satisfied, the effect is the same as that of S reduction. On the other hand, the addition of at least 0.6% of Mn improves adhesion of scale Therefore, Mn is controlled in the range from 0.6% to 2.0%, while satisfying the relation: $Mn/S \geqq 200$.

S: As previously stated, since S is harmful to the weld high temperature affected cracking, it is desirable that S is as small as possible in quantity. However, the smaller S is, the more the cost is needed for the production. Even if S remains up to 0.006%, enough durability to the weld high temperature affected cracking is held on the steel of this invention due to the effect of Mn, so that the upper limit of S is now set as 0.006%.

Ni: As illustrated in Examples, Ni brings about a favorable result of improving toughness like copper does. However, an excessive of Ni gives rise to deposition of an austenite phase at elevated temperatures, and follows the increase of thermal expansion coefficient as well as anxiety about the deterioration of thermal fatigue. Therefore, in the case of the conjoint addition of Ni and Cu according to the invention, the Cu being also an austenite former, it has been found that (Ni +Cu) should be not more than 4%.

Cr:Cr is an indispensable element to improve corrosion resistivity and oxidation resistivity. The reason of limiting Cr as not less than 17% is that the addition of at least 17% of Cr is required to keep a desired level of oxidation resistance at a temperature of at least higher 900° C. In this view, the more Cr is, the better, but the addition of an excessive amount of Cr renders the steel brittle, and deteriorates workability due to increase in hardness. Accordingly, the upper limit of Cr is now set as 25%.

Nb:Nb is a necessary element to maintain high temperature strength. Furthermore, Nb improves workability and oxidation resistivity, and still brings about a favorable influence in the manufacture of pipe by a high frequency welding method. However, Nb reacts and forms compounds with C and N, so that the Nb dissolved in the steel decreases and its effect on high temperature strength decreases also as far as the lower limit of Nb is merely set as 0.2%. Therefore, Nb must meet the condition that [Nb] expressed in the equation, $$[Nb] = Nb\% - 8\,(C+N)\%,$$

is at least 0.2%. On the other hand, when Nb is added in excess, welded parts become susceptible to high temperature affected cracking. The upper limit of Nb is now set as 0.8% so that sufficient high temperature strength may be held and susceptibility to weld high temperature affected cracking may not be influenced so much.

Mo: As already stated, the more addition of Mo make high temperature strength to increase. Besides, Mo is effective to improve high temperature oxidation resistance and corrosion resistivity. However, an excessive addition of it makes low temperature toughness as well as productivity and workability to decrease remarkably. Therefore, Mo is restricted within the range from 1.0% to 4.5%, preferably from 2.0% to 4.5%, still more preferably within the range of more than 2.5% and up to 4.5%.

Cu: As mentioned previously, Cu is an important element of the steel according to the invention because of its remarkable effectiveness on toughness. As shown in FIG. 4, Cu is needed at least 0.1% to achieve an appreciable improvement to toughness, so that the lower limit of Cu is now set as 0.1%. On the contrary, the addition of an excessive amount of Cu renders the steel hard and deteriorates its workability, in particular its hot workability, so that the upper limit of Cu is now set as 2.5%.

Al:Al improves oxidation resistivity at elevated temperatures, but the addition of an excessive amount of Al poses problems on productivity as well as weldability. For this reason the upper limit of Al is now set as 0.5%.

Ti:Ti increases high temperature strength and improves workability. Like aluminum, the addition of an excessive amount of Ti, causes problems on productivity and weldability, so that the upper limit of Ti is now set as 0.5%.

V: Like Ti, V increases high temperature strength and improves workability, but the addition of an excessive amount of V invites reduction in strength. Therefore, the upper limit of V is now set as 0.5%.

Zr:Zr increases high temperature strength and improves oxidation resistance at elevated temperatures. However, the addition of an excessive amount of Zr invites reduction in strength. Therefore, the upper limit of Zr is now set as 1.0%.

W: Similar to Ti and V, W increases high temperature strength and improves workability, but the addition of an excessive amount of W invites reduction in strength, so that the upper limit of W is now set as 1.5%.

B:B improves hot workability, high temperature strength and even workability. However, the addition of an excessive amount of B, adversely affects hot workability, on the contrary, therefore the upper limit of B is now set as 0.01%.

REM: Even in small quantity the addition of rare-earth metal improves hot-workability, oxidation resistance, particularly, adhesion of scale. However, the addition of an excessive amount of REM adversely affects hot workability on the contrary. Therefore, the upper limit of REM is now set as 0.1%.

EXAMPLES

Table 1 shows chemical components, in% by weight, of the tested steels. Steels M1 to M21 are those in accordance with the invention, while Steels M22 to M30 are control steels. Each steel was made into a 30 kg ingot and forged to a rod having a diameter of 25 mm, or to a slab having a thickness of 25 mm. The rod was annealed at a temperature of from 950° C. to 1100° C., and test pieces for the high temperature tensile test in accordance with JIS were prepared from the annealed rod. The slab was cut into pieces, which were heated in a furnace, took out from the furnace at a temperature of 1200° C., hot rolled to plates having a thickness of 5 mm and annealed at a temperature of from 950° C. to 1100° C. Some of the annealed plates were as such worked to Charpy impact test pieces having a thickness of 4.5 mm, while the others were made to cold plates having a thickness of 2 mm of 1.2 mm by repeating cold rolling and annealing. The 2 mm plates were subjected to the high temperature oxidation test, while the 1.2 mm plates were subjected to the high temperature affected weld cracking test.

Table 2 shows tensile strength at elevated temperatures determined by the tensile test in accordance with JIS, amount of scale which splinters off by the oxidation test continued for 100 hours at 900° C. and at 1000° C., critical strain of weldment caused by the high temperature affected cracking test which is previously described, and results of the Charpy impact test carried out on V-notched Charpy impact testing pieces of a thickness of 4.5 mm.

From the results of the tensile test shown in Table 2, it is understood that the addition of Nb, Mo and Ni increases high temperature strength and the conjoint addition of Mo and Cu further improves high temperature strength. The results of the continuous high temperature oxidation tests carried out at 900° C. and at 1000° C., indicate that resistivity of scale splintering off increases remarkably when Mn content exceeds 0.6%. The critical strain caused by the test of high temperature affected weld cracking is highly improved when the ratio, Mn/S, is 200 or higher. The results of the Charpy impact test reveal that while impact toughness decreases by the addition of Mo, it is improved by the addition of Cu, and the same is true with the addition of Ni.

TABLE 1

| | Chemical Components (wt. %) of Treated Steels | | | | | | | | | | | | | | |
|---|---|---|---|---|---|---|---|---|---|---|---|---|---|---|---|
| Steel | C | Si | Mn | P | S | Ni | Cr | Nb | Mo | Cu | N | Other | Mn/S | Ni + Cu | [Nb] |
| A | | | | | | | | | | | | | | | |
| M1 | 0.0112 | 0.45 | 0.81 | 0.025 | 0.0031 | 0.30 | 18.19 | 0.42 | 1.20 | 0.47 | 0.0128 | — | 274 | 1.13 | 0.23 |
| M2 | 0.0118 | 0.40 | 0.70 | 0.022 | 0.0029 | 0.22 | 18.28 | 0.45 | 1.94 | 0.24 | 0.0113 | — | 241 | 0.46 | 0.27 |
| M3 | 0.0140 | 0.25 | 0.63 | 0.020 | 0.0030 | 0.22 | 18.45 | 0.41 | 2.05 | 0.48 | 0.0107 | — | 210 | 0.70 | 0.21 |
| M4 | 0.0121 | 0.25 | 1.42 | 0.020 | 0.0035 | 0.20 | 18.37 | 0.43 | 2.01 | 0.46 | 0.0113 | — | 406 | 0.66 | 0.24 |
| M5 | 0.0106 | 0.40 | 0.79 | 0.023 | 0.0033 | 0.20 | 18.55 | 0.45 | 2.93 | 0.49 | 0.0111 | — | 239 | 0.69 | 0.28 |
| M6 | 0.0106 | 0.37 | 0.78 | 0.023 | 0.0028 | 0.24 | 18.34 | 0.47 | 3.01 | 0.93 | 0.0113 | — | 279 | 1.17 | 0.29 |
| M7 | 0.0097 | 0.43 | 0.79 | 0.021 | 0.0027 | 0.27 | 18.49 | 0.45 | 2.97 | 1.98 | 0.0103 | — | 293 | 2.25 | 0.29 |
| M8 | 0.0102 | 0.42 | 0.85 | 0.020 | 0.0027 | 0.22 | 18.42 | 0.46 | 2.95 | 2.44 | 0.0109 | — | 315 | 2.66 | 0.29 |
| M9 | 0.0136 | 0.48 | 0.69 | 0.019 | 0.0026 | 1.49 | 18.44 | 0.43 | 3.04 | 0.18 | 0.0136 | — | 265 | 1.49 | 0.21 |
| M10 | 0.0126 | 0.49 | 0.68 | 0.017 | 0.0024 | 2.98 | 18.57 | 0.43 | 3.02 | 0.14 | 0.0116 | — | 283 | 2.98 | 0.24 |
| M11 | 0.0110 | 0.41 | 0.76 | 0.023 | 0.0028 | 0.27 | 18.31 | 0.46 | 3.92 | 0.52 | 0.0109 | — | 271 | 0.79 | 0.28 |
| M12 | 0.0108 | 0.42 | 0.76 | 0.024 | 0.0029 | 0.27 | 18.40 | 0.46 | 3.99 | 0.93 | 0.0104 | — | 262 | 1.20 | 0.29 |
| M13 | 0.0114 | 0.38 | 0.73 | 0.023 | 0.0027 | 0.23 | 18.22 | 0.46 | 4.02 | 1.88 | 0.0112 | — | 270 | 2.11 | 0.28 |
| M14 | 0.0105 | 0.42 | 0.79 | 0.022 | 0.0028 | 0.21 | 18.37 | 0.45 | 4.42 | 0.95 | 0.0104 | — | 282 | 1.16 | 0.28 |
| M15 | 0.0107 | 0.39 | 0.92 | 0.023 | 0.0039 | 0.24 | 18.47 | 0.46 | 2.98 | 0.49 | 0.0110 | Al: 0.45 | 236 | 0.73 | 0.29 |
| M16 | 0.0116 | 0.42 | 0.79 | 0.020 | 0.0028 | 0.26 | 18.29 | 0.47 | 3.12 | 0.51 | 0.0109 | Ti: 0.17 | 282 | 0.77 | 0.29 |
| M17 | 0.0112 | 0.41 | 0.82 | 0.022 | 0.0031 | 0.22 | 18.36 | 0.44 | 3.06 | 0.50 | 0.0121 | V: 0.26 | 265 | 0.72 | 0.25 |
| M18 | 0.0110 | 0.41 | 0.82 | 0.022 | 0.0028 | 0.26 | 18.37 | 0.46 | 3.06 | 0.46 | 0.0101 | Zr: 0.73 | 293 | 0.72 | 0.29 |
| M19 | 0.0102 | 0.38 | 0.85 | 0.021 | 0.0033 | 0.25 | 18.51 | 0.45 | 3.01 | 0.51 | 0.0106 | W: 0.89 | 258 | 0.76 | 0.28 |
| M20 | 0.0098 | 0.40 | 0.71 | 0.021 | 0.0032 | 0.20 | 18.40 | 0.48 | 2.99 | 0.49 | 0.0103 | B: 0.004 | 222 | 0.69 | 0.32 |
| M21 | 0.0125 | 0.41 | 0.76 | 0.020 | 0.0028 | 0.23 | 18.38 | 0.43 | 3.02 | 0.51 | 0.0105 | REM: 0.05 | 271 | 0.74 | 0.25 |
| B | | | | | | | | | | | | | | | |
| M22 | 0.0126 | 0.44 | 0.83 | 0.026 | 0.0034 | 0.20 | 17.95 | 0.46 | 0.18 | 0.13 | 0.0099 | — | 244 | 0.33 | 0.28 |
| M23 | 0.0054 | 0.42 | 0.83 | 0.021 | 0.0025 | 0.19 | 18.37 | 0.40 | 0.22 | 0.44 | 0.0103 | — | 332 | 0.63 | 0.27 |
| M24 | 0.0103 | 0.49 | 0.74 | 0.022 | 0.0027 | 0.24 | 17.23 | 0.41 | 0.25 | 0.89 | 0.0141 | — | 274 | 1.13 | 0.29 |
| M25 | 0.0091 | 0.39 | 0.80 | 0.019 | 0.0018 | 0.23 | 18.37 | 0.49 | — | — | 0.0105 | — | 444 | 0.23 | 0.33 |
| M26 | 0.0120 | 0.25 | 0.39 | 0.021 | 0.0023 | 0.21 | 18.25 | 0.41 | 2.04 | — | 0.0110 | — | 170 | 0.21 | 0.23 |
| M27 | 0.0114 | 0.37 | 0.26 | 0.023 | 0.0032 | 0.22 | 18.35 | 0.43 | 2.09 | 0.42 | 0.0109 | — | 81 | 0.64 | 0.24 |
| M28 | 0.0128 | 0.47 | 0.49 | 0.024 | 0.0036 | 0.20 | 18.49 | 0.05 | 2.06 | 0.35 | 0.0117 | — | 136 | 0.55 | −0.15 |
| M29 | 0.0132 | 0.48 | 0.40 | 0.021 | 0.0028 | 0.23 | 18.43 | 0.19 | 3.02 | — | 0.0107 | — | 143 | 0.66 | 0 |
| M30 | 0.0126 | 0.50 | 0.98 | 0.022 | 0.0035 | 0.25 | 18.76 | 0.47 | 4.01 | — | 0.0108 | — | 280 | 0.25 | 0.28 |

Note:

[Nb] = Nb% − 8(C% + N%)

A: According to the invention

B: Control

TABLE 2

| Steel | Tensile strength at elevated temperatures (kg/mm²) 700° C. | 900° C. | Amount of scale splintering after oxida-tion test (mg/cm²) 900° C. | 1000° C. | Critical strain upon welding (%) | Charpy impact strength (kg-m/cm²) −25° C. | 0° C. | 25° C. |
|---|---|---|---|---|---|---|---|---|
| A | | | | | | | | |
| M1 | 21.7 | 4.2 | 0.07 | 0.12 | 4.7 | 18.9 | 20.2 | 24.2 |
| M2 | 22.0 | 4.3 | 0.05 | 0.09 | 4.5 | 13.9 | 17.2 | 23.3 |
| M3 | 22.2 | 4.4 | 0.04 | 0.08 | 4.0 | 19.0 | 21.7 | 27.6 |
| M4 | 22.2 | 4.5 | 0.02 | 0.04 | 5.1 | 19.0 | 21.7 | 27.6 |
| M5 | 22.4 | 4.6 | 0.01 | 0.03 | 3.9 | 10.3 | 11.0 | 18.9 |
| M6 | 22.8 | 4.7 | 0.02 | 0.03 | 4.1 | 10.7 | 17.5 | 18.3 |
| M7 | 23.1 | 4.8 | 0.01 | 0.04 | 4.4 | 6.4 | 13.6 | 16.9 |
| M8 | 23.2 | 4.7 | 0.01 | 0.03 | 4.5 | 4.0 | 6.8 | 9.7 |
| M9 | 22.5 | 4.8 | 0.01 | 0.04 | 4.1 | 5.9 | 13.9 | 17.8 |
| M10 | 22.7 | 4.8 | 0.02 | 0.03 | 4.1 | 6.8 | 14.7 | 17.4 |
| M11 | 23.0 | 4.9 | 0.01 | 0.02 | 3.5 | 5.2 | 8.6 | 16.7 |
| M12 | 23.3 | 5.0 | 0.01 | 0.02 | 3.7 | 7.1 | 14.9 | 16.3 |
| M13 | 23.6 | 5.2 | 0.02 | 0.04 | 3.6 | 5.2 | 8.0 | 9.8 |
| M14 | 23.4 | 5.1 | 0.01 | 0.03 | 3.7 | 6.2 | 9.7 | 12.3 |
| M15 | 22.9 | 4.9 | 0.01 | 0.02 | 3.5 | 8.5 | 9.0 | 16.1 |
| M16 | 21.9 | 4.7 | 0.02 | 0.03 | 4.3 | 9.2 | 10.7 | 17.2 |
| M17 | 21.7 | 4.7 | 0.02 | 0.03 | 3.9 | 10.4 | 11.8 | 19.2 |
| M18 | 21.9 | 4.8 | 0.01 | 0.03 | 4.3 | 10.2 | 13.1 | 19.7 |
| M19 | 21.9 | 4.8 | 0.01 | 0.02 | 4.5 | 9.7 | 11.7 | 20.3 |
| M20 | 21.8 | 4.7 | 0.01 | 0.02 | 3.7 | 10.1 | 10.9 | 19.1 |
| B | | | | | | | | |
| M21 | 21.7 | 4.7 | 0.01 | 0.01 | 3.9 | 8.9 | 10.2 | 17.1 |
| M22 | 19.4 | 3.1 | 0.10 | 0.22 | 3.9 | 15.6 | 21.1 | 25.5 |
| M23 | 19.6 | 3.1 | 0.11 | 0.25 | 4.2 | 25.0 | 21.4 | 29.9 |
| M24 | 20.0 | 3.2 | 0.11 | 0.28 | 4.4 | 18.1 | 19.3 | 23.2 |
| M25 | 19.4 | 3.0 | 0.10 | 0.24 | 5.0 | 6.4 | 9.2 | 12.9 |
| M26 | 20.9 | 3.5 | 0.20 | 0.96 | 2.8 | 2.0 | 8.1 | 22.3 |
| M27 | 19.1 | 2.9 | 0.32 | 1.32 | 2.0 | 17.9 | 20.5 | 22.3 |
| M28 | 19.3 | 2.9 | 0.14 | 0.76 | 2.5 | 2.0 | 8.1 | 22.3 |
| M29 | 19.4 | 3.4 | 0.16 | 0.66 | 1.9 | 1.9 | 6.0 | 6.7 |
| M30 | 22.9 | 4.7 | 0.07 | 0.09 | 3.4 | 1.0 | 1.1 | 1.13 |

Note:
A: According to the invention
B: Control

Having so described, the invention has provided a heat resistive ferritic stainless steel which achieves the above-mentioned object and which has excellent high temperature strength, resistance to high temperature oxidation, resistance to high temperature affected weld cracking, improved low temperature toughness, which is serious drawback of the ferritic stainless steel. Accordingly, the novel and useful material responsible to the progressive increase of power and capability of the engine has now been offered for an automobile exhaust gas system, particularly, for a pipe between an engine and a converter, which pipe is prepared by welding or jointed to other parts by welding.

What is claimed is:

1. A heat resisting ferritic stainless steel excellent in low temperature toughness, weldability, and heat resistance which comprises, by weight, an amount greater than zero and up to 0.03% of C,
from 0.1 to 0.8% of Si,
from 0.6 to 2.0% of Mn,
up to 0.006% of S,
up to 4% of Ni,
from 17.0 to 25.0% of Cr,
from 0.2 to 0.8% of Nb,
from 1.0 to 4.5% of Mo,
from 0.1 to 2.5% of Cu, and
an amount greater than zero and up to 0.03% of N, the balance being Fe and unavoidable impurities, wherein the alloying elements are further adjusted so that the ratio of Mn%/S% is not less than 200, [Nb] defined by the equation:

$$[Nb]=Nb\%-8\,(C\%+N\%)$$

is not less than 0.2, and (Ni%+Cu%) is not more than 4.

2. The heat resisting ferritic stainless steel excellent in low temperature toughness, weldability, and heat resistance which comprises, by weight:

an amount greater than zero and up to 0.03% of C,
from 0.1 to 0.8% of Si,
from 0.6 to 2.0% of Mn,
up to 0.006% of S,
up to 4% of Ni,
from 17.0 to 25.0% of Cr,
from 0.2 to 0.8% of Nb,
from more than 2.5 to 4.5% of Mo,
from 0.1 to 2.5% of Cu, and
an amount greater than zero and up to 0.03% of N, the balance being Fe and unavoidable impurities, wherein the alloying elements are further adjusted so that the ratio of Mn%/S% is not less than 200, [Nb] defined by the equation:

$$[Nb]=Nb\%-8\,(C\%+N\%)$$

is not less than 0.2, and (Ni%+Cu%) is not more than 4.

3. A heat resisting ferritic stainless steel excellent in low temperature toughness, weldability and heat resistance which comprises, by weight, an amount greater than zero and up to 0.03% of C,
from 0.1 to 0.8% of Si,
from 0.6 to 2.0% of Mn,
up to 0.006% of S,
up to 4% of Ni,
from 17.0 to 25.0% of Cr,
from 0.2 to 0.8% of Nb,
from 1.0 to 4.5% of Mo,
from 0.1 to 2.5% of Cu,
an amount greater than zero and up to 0.03% of N,
up to 0.5% of Al,
up to 0.6% of Ti,
up to 0.5% of V,
up to 1.0% of Zr,
up to 1.5% of W,
up to 0.01% of B, and
up to 0.1% of REM, the balance being Fe and unavoidable impurities, wherein the alloying elements are further adjusted so that the ratio of Mn%/S% is not less than 200, [Nb] defined by the equation:

$$[Nb]=Nb\%-8\,(C\%+N\%)$$

is not less than 0.2, and (Ni%+Cu%) is not more than 4.

4. A heat resisting ferritic stainless steel excellent in low temperature toughness, weldability and heat resistance which comprises, by weight, an amount greater than zero and up to 0.03% of C,
from 0.1 to 0.8% of Si,
from 0.6 to 2.0% of Mn,
up to 0.006% of S,
up to 4% of Ni,
from 17.0 to 25.0% of Cr,
from 0.2 to 0.8% of Nb,
from more than 2.5 to 4.5% of Mo,
from 0.1 to 2.5% of Cu,
an amount greater than zero and up to 0.03% of N,
up to 0.5% of Al,
up to 0.6% of Ti
up to 0.5% of V
up to 1.0% of Zr,
up to 1.5% of W,
up to 0.01% of B, and
up to 0.1% of REM, the balance being Fe and unavoidable impurities, wherein the alloying elements are further adjusted so that the ratio of Mn%/S% is not less than 200, [Nb] defined by the equation:

$$[Nb]=Nb\%-8\,(C\%+N\%)$$

is not less than 0.2, and (Ni%+Cu%) is not more than 4.

5. The heat resisting ferritic stainless steel in accordance with claim 1 for use in constructing an exhaust gas pipe from an engine to an exhaust gas purifying instrument.

6. The heat resisting ferritic stainless steel in accordance with claim use in constructing an exhaust gas pipe from an engine to an exhaust gas purifying instrument.

7. The heat resisting ferritic stainless steel in accordance with claim 3 for use in constructing an exhaust gas pipe from an engine to an exhaust gas purifying instrument.

8. The heat resisting ferritic stainless steel in accordance with claim 4 for use in constructing an exhaust gas pipe from an engine to an exhaust gas purifying instrument.

9. The heat resisting ferritic stainless steel in accordance with claim 1 wherein the lower limit of C is 0.0098% by weight and the lower limit of N is 0.0099% by weight.

10. The heat resisting ferritic stainless steel in accordance with claim 3 wherein the lower limit of C is 0.0098% by weight and the lower limit of N is 0.0099% by weight.

* * * * *